US012115423B1

(12) United States Patent
Kleinvehn

(10) Patent No.: US 12,115,423 B1
(45) Date of Patent: Oct. 15, 2024

(54) DIVOT REPAIR TOOL ASSEMBLY

(71) Applicant: Steven Kleinvehn, Champaign, IL (US)

(72) Inventor: Steven Kleinvehn, Champaign, IL (US)

( * ) Notice: Subject to any disclaimer, the term of this patent is extended or adjusted under 35 U.S.C. 154(b) by 0 days.

(21) Appl. No.: 18/212,255

(22) Filed: Jun. 21, 2023

(51) Int. Cl.
*A63B 57/50* (2015.01)

(52) U.S. Cl.
CPC ..... *A63B 57/50* (2015.10)

(58) Field of Classification Search
CPC ..... A63B 57/50; A63B 57/203; A63B 57/20
See application file for complete search history.

(56) References Cited

U.S. PATENT DOCUMENTS

| | | | | | |
|---|---|---|---|---|---|
| 1,703,139 | A * | 2/1929 | Falcone | A63B 57/203 | 206/315.1 |
| 1,744,104 | A * | 1/1930 | Carroll | A63B 57/0032 | D9/701 |
| 1,789,910 | A * | 1/1931 | Marks | A63B 57/0032 | 473/391 |
| 3,272,412 | A * | 9/1966 | Antonious | A63B 57/0032 | D9/701 |
| 3,830,415 | A * | 8/1974 | Jacobson | A63B 57/0032 | 224/230 |
| D338,254 | S * | 8/1993 | Ribbeck | D3/229 | |
| 5,269,410 | A * | 12/1993 | Abregano | A63B 57/203 | 206/315.3 |
| 5,643,113 | A * | 7/1997 | Rodgers | A63B 57/0037 | 473/282 |
| 6,102,201 | A * | 8/2000 | Marston | A63B 57/207 | 224/919 |
| D494,244 | S | 8/2004 | Jacome | | |
| 6,872,155 | B2 | 3/2005 | Jacome | | |
| D610,644 | S * | 2/2010 | Song | D21/796 | |
| 8,382,615 | B2 | 2/2013 | Carsey | | |
| 2002/0123396 | A1* | 9/2002 | Joo | A63B 57/12 | 473/393 |
| 2002/0187861 | A1 | 12/2002 | Jacome | | |
| 2003/0006154 | A1* | 1/2003 | Chen | A63B 47/001 | 206/315.9 |
| 2005/0103661 | A1* | 5/2005 | Dorner | A63B 57/203 | 206/315.1 |
| 2007/0149325 | A1 | 1/2007 | Vargas | | |

FOREIGN PATENT DOCUMENTS

| | | | | |
|---|---|---|---|---|
| CA | 3146766 | | 7/2002 | |
| FR | 2821757 | A1 * | 9/2002 | A63B 57/0031 |
| GB | 348896 | A * | 5/1931 | |
| GB | 353272 | A * | 7/1931 | |
| GB | 586361 | A * | 3/1947 | |
| WO | WO-2004020051 | A1 * | 3/2004 | A63B 57/0032 |

* cited by examiner

*Primary Examiner* — Steven B Wong

(57) ABSTRACT

A divot repair tool assembly for removing divots from a golf course green includes a planar body with a pair of holes extending through the planar body. Golf tees are insertable through the holes, and the planar body may be wrapped around the heads of the golf tees to secure the golf tees to the planar body and prevent movement of the golf tees with respect to each other and the planar body. The assembly may then be used to remove divots in a golf course green.

12 Claims, 4 Drawing Sheets

DIVOT REPAIR TOOL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to divot removal tools and more particularly pertains to a new divot removal tool for removing divots from a golf course green.

(2) Description of Related Art Including Information Disclosed Under 37 CFR 1.97 and 1.98

The prior art describes several divot removal tools which are adapted for use with golf tees. In such divot removal tools, the golf tees are typically secured in elongated channels which extend through a rigid body. Then the golf tees are used to insert into the golf course green and push soil to flatten out divots made in the green. However, the prior art fails to describe such a device in which the body comprises a bendable, flexible material with a planar shape. The body of such a new device would be able to be stored in containing devices unadaptable to containing thicker and more rigid bodies of the prior art. For example, the body of the new device could be stored in a wallet, money clip, or the like. Instead of relying on elongated channels to prevent movement of the golf tees during use, the new device could wrap around the heads of the golf tees so that a user may securely grasp the heads via the body. The new device could also be constructed primarily of cardboard or other disposable materials to minimize the cost of losing the small device.

BRIEF SUMMARY OF THE INVENTION

An embodiment of the disclosure meets the needs presented above by generally comprising a body which is planar and has a first end and a second end. The body has a top surface and a bottom surface extending between the first and second ends. The body also has a first outer portion, a second outer portion, and a middle portion. The first outer portion is positioned adjacent to the first end, the second outer portion is positioned adjacent to the second end, and the middle portion is coupled to and extending between the first and second outer portions. The body has a pair of holes extending through the middle portion. The body comprises a bendable material such that the first and second outer portions are bendable upwardly with respect to the middle portion and inwardly toward each other to form a closed loop.

A pair of golf tees is couplable to the body. Each golf tee of the pair of golf tees has a shank and a head which are coupled to each other. The shank has a pointed end opposite the head, and the shank of each golf tee of the pair of golf tees is insertable into an associated one of the pair of holes of the body such that the pointed end of the golf tee points downwardly with respect to the body. The head of each golf tee of the pair of golf tees has a width greater than a width of the associated hole. The body and the pair of golf tees are positionable in a use condition wherein the shank of each golf tee of the pair of golf tees is inserted into the associated hole and the body surrounds and abuts the head of each golf tee of the pair of golf tees within the closed loop.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
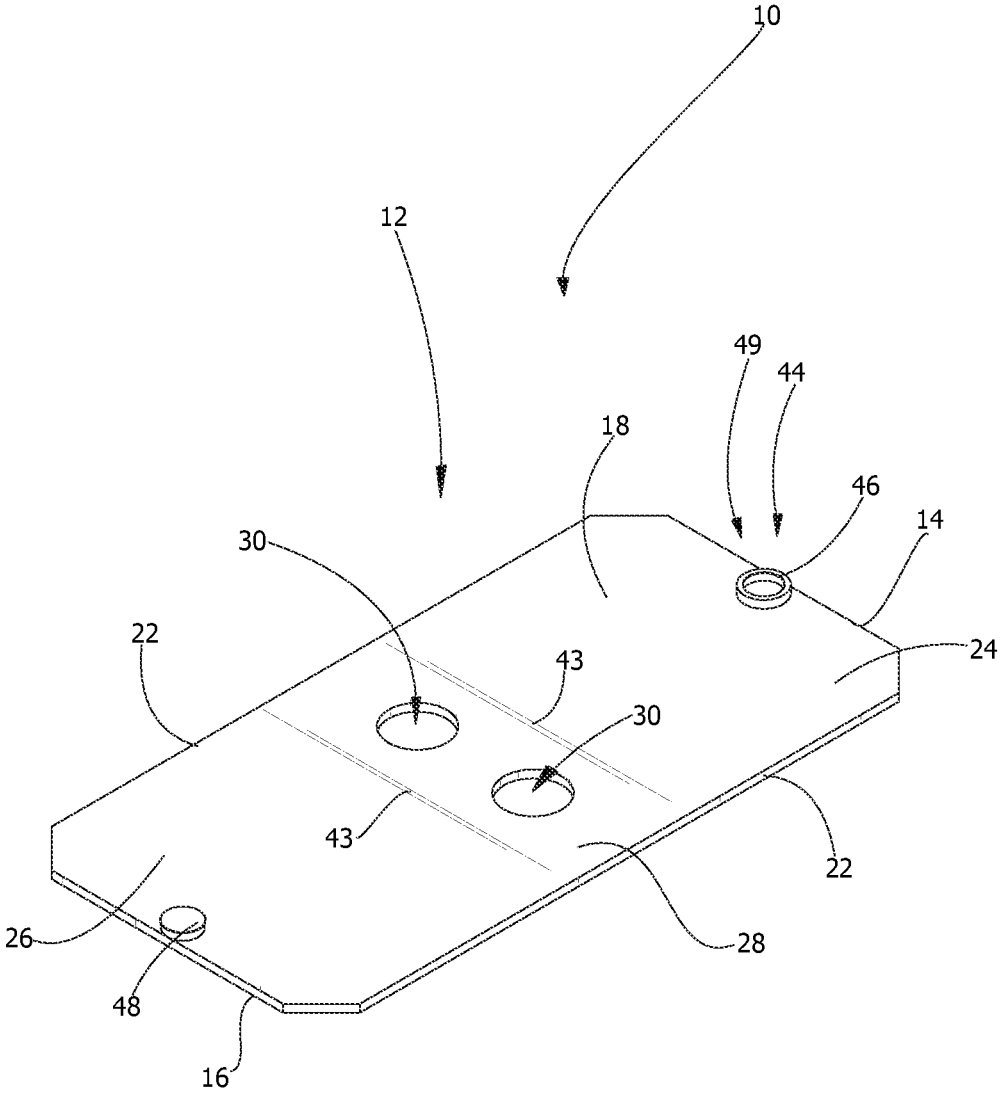
FIG. 1 is a perspective view of a body of a divot repair tool assembly according to an embodiment of the disclosure.
Figure 2:
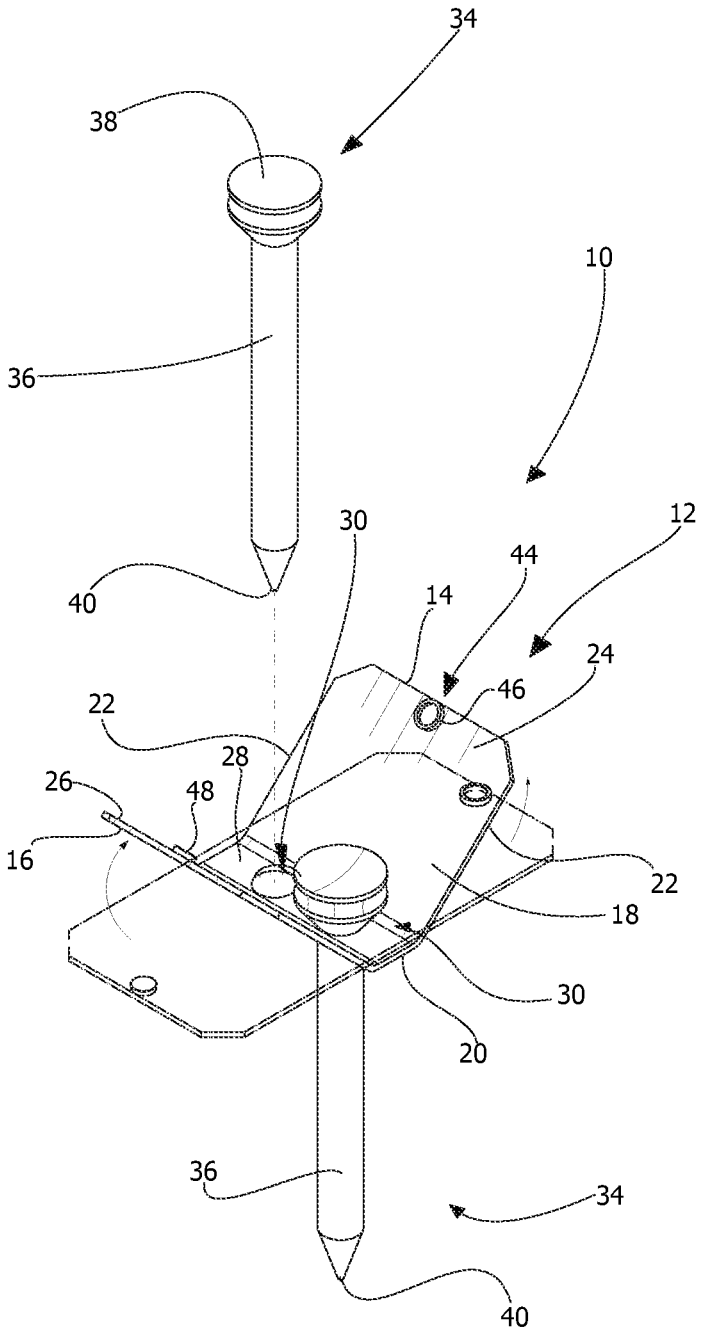
FIG. 2 is an exploded view of an embodiment of the disclosure.
Figure 3:
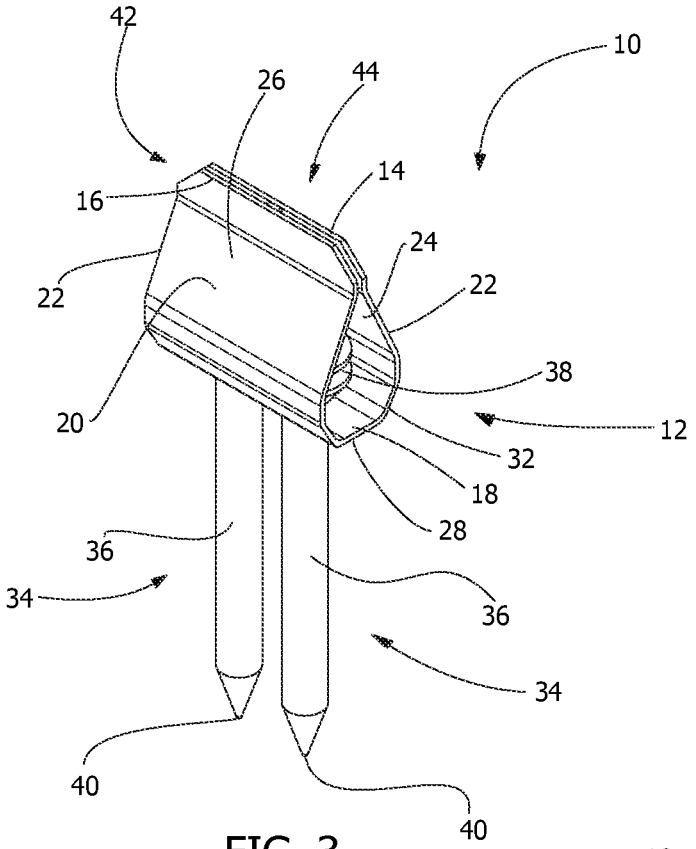
FIG. 3 is a perspective view of an embodiment of the disclosure.
Figure 4:
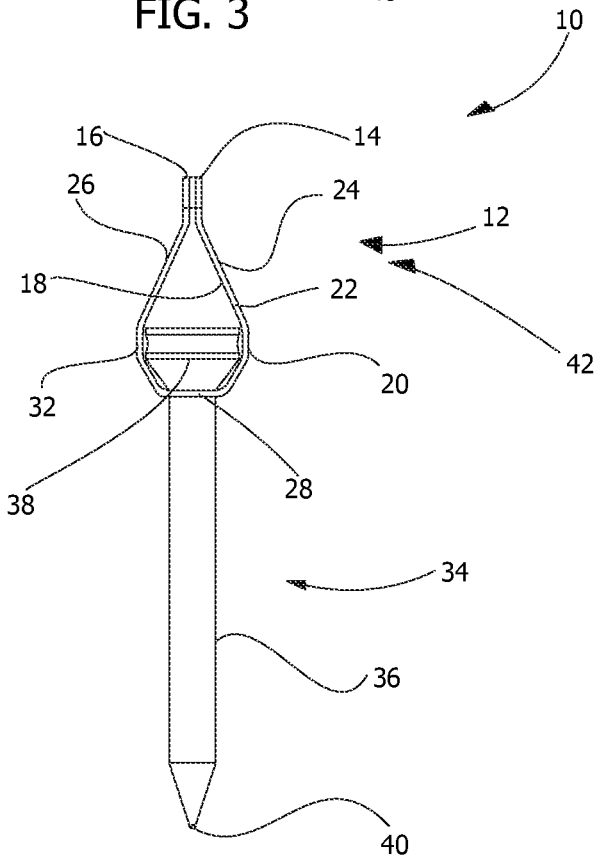
FIG. 4 is a side view of an embodiment of the disclosure.
Figure 5:
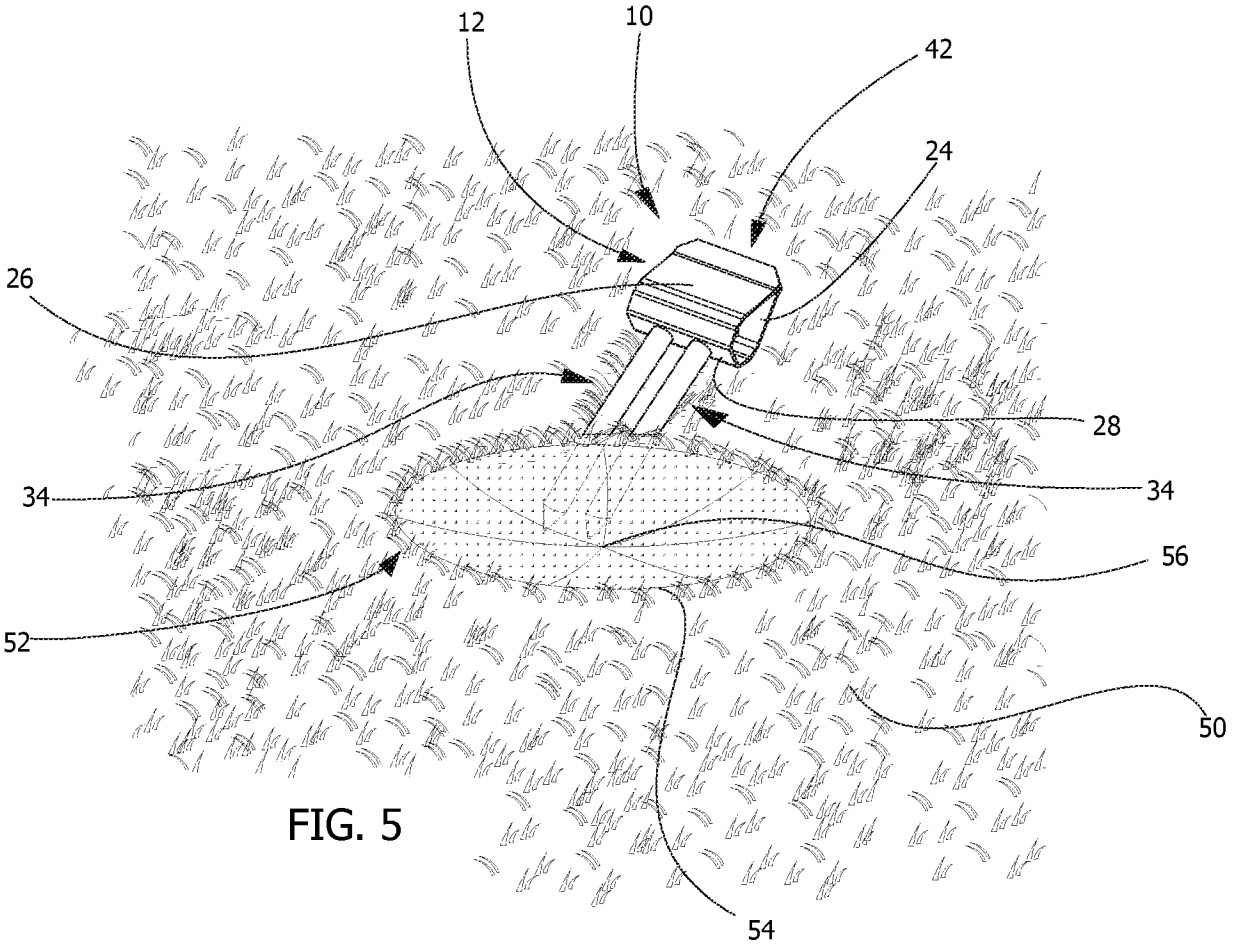
FIG. 5 is an in-use view of an embodiment of the disclosure.

With reference now to the drawings, and in particular to FIGS. 1 through 5 thereof, a new divot removal tool embodying the principles and concepts of an embodiment of the disclosure and generally designated by the reference numeral 10 will be described.

As best illustrated in FIGS. 1 through 5, the divot repair tool assembly 10 generally comprises a body 12 which is planar and has a first end 14 and a second end 16. The body 12 has a top surface 18 and a bottom surface 20 extending between the first and second ends 14, 16. The body 12 also has a first outer portion 24, a second outer portion 26, and a middle portion 28. The first outer portion 24 is positioned adjacent to the first end 14, the second outer portion 26 is positioned adjacent to the second end 16, and the middle portion 28 is coupled to and extends between the first and second outer portions 24, 26. The body 12 has a pair of holes 30 extending through the middle portion 28 which is arranged along a line extending perpendicularly to a center axis extending from the first end 14 of the body 12 to the second end 16 of the body 12. A length of each hole 30 of said pair of holes 30 between said top surface 18 and said bottom surface 20 of said body 12 being less than a width of said hole 30. The body 12 comprises a bendable material such that the first and second outer portions 24, 26 are bendable upwardly with respect to the middle portion 28 and inwardly toward each other to form a closed loop 32.

A pair of golf tees 34 is couplable to the body 12. Each golf tee 34 of the pair of golf tees 34 has a shank 36 and a head 38 that are coupled to each other, and the shank 36 has a pointed end 40 opposite the head 38. The shank 36 of each golf tee 34 of the pair of golf tees 34 is insertable into an associated one of the pair of holes 30 of the body 12 such that the pointed end 40 of the golf tee 34 points downwardly with respect to the body 12. The head 38 of each golf tee 34 of the pair of golf tees 34 has a width greater than the width of the associated hole 30 such that the head 38 of each golf tee 34 retains the golf tee 34 to the body 12 when the shank 36 is inserted through the associated hole 30.

The body 12 and the pair of golf tees 34 are positionable in a use condition 42 wherein the shank 36 of each golf tee 34 of the pair of golf tees 34 is inserted into the associated hole 30 and the body 12 surrounds and abuts the head 38 of each golf tee 34 of the pair of golf tees 34 within the closed loop 32. The bendable material is flexible such that the body 12 is conformable to the heads 38 of the pair of golf tees 34 when the body 12 and the pair of golf tees 34 are positioned in the use condition 42. The body 12 may comprise a cardboard material, a paper material, a plastic material, a fabric material, or the like.

The body 12 has a pair of grooves 43 extending into the top surface 18 to facilitate bending the first and second outer portions 24, 26 with respect to the middle portion 28. Each groove 43 of the pair of grooves 43 is positioned at a junction between the middle portion 28 and an associated one of the first and second outer portions 24, 26. Each groove 43 of the pair of grooves 43 extends perpendicularly to the center axis. The body 12 is elongated between the first and second ends 14, 16. The body 12 has a length between the first and second ends 14, 16 of between 3.5 inches and 4.5 inches, a width between a pair of lateral edges 22 of between 1.5 inches and 2.5 inches, and a thickness between the top surface 18 and the bottom surface 20 of less than 0.125 inches.

A fastener 44 is coupled to the first and second outer portions 24, 26 to releasably secure the first outer portion 24 to the second outer portion 26. The fastener 44 comprises a first mating member 46 which is coupled to the first outer portion 24 and a second mating member 48 which is coupled to the second outer portion 26. The first mating member 46 is positioned on the top surface 18 adjacent to the first end 14, and the second mating member 48 is positioned on the top surface 18 adjacent to the second end 16. The fastener 44 comprises a snap button 49 but may comprise a hook-and-loop fastener, a magnetic fastener, a clip, or the like.

In use, the divot repair tool assembly 10 is positioned in the use condition 42. The body 12 is gripped to press the body 12 against the heads 38 of the pair of golf tees 34 to secure the heads 38 in the closed loop 32 and prevent movement of the golf tees 34 of the pair of golf tees 34 with respect to each other and the body 12. The pointed ends 40 of the pair of golf tees 34 are inserted into a ground surface 50 adjacent to an outer edge 54 of a divot 52, and the pair of golf tees 34 are moved inwardly with respect to the divot 52 to push a quantity of soil toward a center 56 of the divot 52. Pushing the quantity of soil in this manner causes the ground surface 50 to reform to remove the divot 52 and flatten out. The ground surface 50 at the location of where the divot 52 was may be compacted to retain the newly flattened shape of the ground surface 50 by, for example, tamping a golf club against the ground surface 50. The divot repair tool assembly 10 may, in some cases, be disposed of after use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A divot repair tool assembly comprising:

a body being planar and having a first end and a second end, the body having a top surface and a bottom surface extending between the first and second ends, the body having a first outer portion, a second outer portion, and a middle portion, the first outer portion being positioned adjacent to the first end, the second outer portion being positioned adjacent to the second end, the middle portion being coupled to and extending between the first and second outer portions, the body having a pair of holes extending through the top surface and the bottom surface of the body through the middle portion, the body comprising a bendable material such that the first and second outer portions are bendable upwardly with respect to the middle portion and inwardly toward each other to form a closed loop; and a pair of golf tees being couplable to the body, each golf tee of the pair of golf tees having a shank and a head being coupled to each other, the shank having a pointed end opposite the head, the shank of each golf tee of the pair of golf tees being insertable into an associated one of the pair of holes of the body such that the pointed end of the golf tee points downwardly with respect to the body, the head of each golf tee of the pair of golf tees having a width greater than a width of the associated hole;

wherein the body and the pair of golf tees are positionable in a use condition wherein the shank of each golf tee of the pair of golf tees is inserted into the associated hole and the body surrounds and abuts the head of each golf tee of the pair of golf tees within the closed loop, the pointed ends of the golf tees being positioned outside of and pointing away from the closed loop formed by the body when the body and the pair of golf tees are positioned in the use condition.

2. The assembly of claim 1, wherein the bendable material is flexible such that the body is conformable to the heads of the pair of golf tees when the body and the pair of golf tees are positioned in the use condition.

3. The assembly of claim 1, wherein the pair of holes is arranged along a line extending perpendicularly to a center axis of the body extending from the first end of the body to the second end of the body.

4. The assembly of claim 1, wherein a length of each hole of said pair of holes between said top surface and said bottom surface of said body is less than said width of said hole.

5. The assembly of claim 1, wherein the body has a pair of grooves extending into the top surface to facilitate bending the first and second outer portions with respect to the middle portion, each groove of the pair of grooves being positioned at a junction between the middle portion and an associated one of the first and second outer portions.

6. The assembly of claim 5, wherein each groove of the pair of grooves extends perpendicularly to a center axis of the body extending from the first end of the body to the second end of the body.

7. The assembly of claim 1, wherein the body is elongated between the first and second ends, the body having a length between the first and second ends of between 3.5 inches and 4.5 inches, the body having a width between a pair of lateral edges of between 1.5 inches and 2.5 inches.

8. The assembly of claim 1, wherein the body has a thickness between the top surface and the bottom surface of less than 0.125 inches.

9. The assembly of claim 1, further comprising a fastener being coupled to the first and second outer portions to releasably secure the first outer portion to the second outer portion, the fastener comprising a first mating member being coupled to the first outer portion and a second mating member being coupled to the second outer portion.

10. The assembly of claim 9, wherein the first mating member is positioned on the top surface adjacent to the first end, the second mating member being positioned on the top surface adjacent to the second end.

11. The assembly of claim 9, wherein the fastener comprises a snap button.

12. A divot repair tool assembly comprising:

a body being planar and having a first end and a second end, the body having a top surface and a bottom surface extending between the first and second ends, the body having a first outer portion, a second outer portion, and a middle portion, the first outer portion being positioned adjacent to the first end, the second outer portion being positioned adjacent to the second end, the middle portion being coupled to and extending between the first and second outer portions, the body having a pair of holes extending through the top surface and the bottom surface of the body through the middle portion, the pair of holes being arranged along a line extending perpendicularly to a center axis extending from the first end of the body to the second end of the body, a length of each hole of said pair of holes between said top surface and said bottom surface of said body being less than a width of said hole, the body comprising a bendable material such that the first and second outer portions are bendable upwardly with respect to the middle portion and inwardly toward each other to form a closed loop, the body having a pair of grooves extending into the top surface to facilitate bending the first and second outer portions with respect to the middle portion, each groove of the pair of grooves being positioned at a junction between the middle portion and an associated one of the first and second outer portions, each groove of the pair of grooves extending perpendicularly to the center axis, the body being elongated between the first and second ends, the body having a length between the first and second ends of between 3.5 inches and 4.5 inches, the body having a width between a pair of lateral edges of between 1.5 inches and 2.5 inches, the body having a thickness between the top surface and the bottom surface of less than 0.125 inches;

a pair of golf tees being couplable to the body, each golf tee of the pair of golf tees having a shank and a head being coupled to each other, the shank having a pointed end opposite the head, the shank of each golf tee of the pair of golf tees being insertable into an associated one of the pair of holes of the body such that the pointed end of the golf tee points downwardly with respect to the body, the head of each golf tee of the pair of golf tees having a width greater than said width of the associated hole;

wherein the body and the pair of golf tees are positionable in a use condition wherein the shank of each golf tee of the pair of golf tees is inserted into the associated hole and the body surrounds and abuts the head of each golf tee of the pair of golf tees within the closed loop, the pointed ends of the golf tees being positioned outside of and pointing away from the closed loop formed by the body when the body and the pair of golf tees are positioned in the use condition, the bendable material being flexible such that the body is conformable to the heads of the pair of golf tees when the body and the pair of golf tees are positioned in the use condition; and a fastener being coupled to the first and second outer portions to releasably secure the first outer portion to the second outer portion, the fastener comprising a first mating member being coupled to the first outer portion and a second mating member being coupled to the second outer portion, the first mating member being positioned on the top surface adjacent to the first end, the second mating member being positioned on the top surface adjacent to the second end, the fastener comprising a snap button.

* * * * *